US005400453A

United States Patent [19]

Hamann

[11] Patent Number: 5,400,453

[45] Date of Patent: Mar. 28, 1995

[54] METHOD AND EQUIPMENT FOR DYEING TEXTILES

[75] Inventor: Hans-Jorg Hamann, Hessenstr. 1, 3012 Langenhagen, Germany

[73] Assignee: Hans-Jorg Hamann, Wedemark, Germany

[21] Appl. No.: 221,454

[22] Filed: Apr. 1, 1994

Related U.S. Application Data

[63] Continuation of Ser. No. 922,101, Jul. 31, 1992, abandoned.

[30] Foreign Application Priority Data

Aug. 16, 1991 [DE] Germany ..... 41 27 139.4

[51] Int. Cl.[6] ..... D06B 5/22

[52] U.S. Cl. ..... 8/149.1; 68/5 C; 68/27; 68/183; 68/207; 8/157; 8/158

[58] Field of Search ..... 8/149.1, 157, 158; 68/5 C, 27, 183, 207

[56] References Cited

U.S. PATENT DOCUMENTS

| | | | |
|---|---|---|---|
| 425,614 | 4/1890 | Klauder | 68/27 |
| 509,351 | 11/1893 | Maertens | 68/27 X |
| 523,047 | 7/1894 | Masurel | 68/27 |
| 585,752 | 7/1897 | Halliwell | 68/27 |
| 796,382 | 8/1905 | Willard | 68/27 |
| 836,101 | 11/1906 | Dumons | 68/27 |
| 1,576,378 | 3/1926 | Thies | 68/27 |
| 3,914,962 | 10/1975 | Doire et al. | 68/183 X |
| 3,960,487 | 6/1976 | Stritzko | 68/183 X |
| 4,165,623 | 8/1979 | Negola et al. | 68/5 C |
| 4,183,233 | 1/1980 | Brown | 68/5 C |

*Primary Examiner*—Philip R. Coe
*Attorney, Agent, or Firm*—Longacre & White

[57] ABSTRACT

The invention concerns a method for dyeing textiles, whereby textiles are loaded with a dye liquor containing dye in diluted form; several mutually separate dye compartments (dye containers) being provided and mounted in a zone above the dyeing chamber receiving the textiles to be treated. Several textile pieces are processed simultaneously in the dyeing chamber of which the base zone comprises supply lines with upwardly directed supply apertures for steam and for the dye liquor. Thus, it possible to deposit colors structured as pictures across wide areas and differing from each other on a variety of textiles. Furthermore, uniform dye soaking of the textiles is achieved in spite of such image designs. For that purpose, the invention provides that the dye liquor is made to pass from below to above through the textiles using pressurized transport media at raised pressure.

17 Claims, 3 Drawing Sheets

18
17
2
36
35
20
34
20
33
4
31
23
22
5
32
30
29
14
3
28
25
12
11
6
10
9
27
26a

METHOD AND EQUIPMENT FOR DYEING TEXTILES

This is a Continuation of application Ser. No. 07/922,101, filed on 31 Jul. 1992, now abandoned.

BACKGROUND OF THE INVENTION a) Field of the Invention

The invention concerns a method and equipment for dyeing textiles, whereby the textiles to be dyed are loaded with a dye liquor containing highly diluted dye. Several separate dye compartments (dye containers) are mounted above a dyeing chamber receiving the textiles to be treated, whereby several textile pieces are simultaneously treated in the dyeing chamber of which the base zone comprises supply lines with upwardly directed supply apertures for steam and dye liquor.

Because the dye concentration is very low in such a known method, there is no need for the often desired dye post-flushing down to a low value and substantial savings are achieved, especially as regards waste disposal. Because no dye flushing takes place, corresponding waste disposal is also eliminated.

b) Description of Related Art

In this known method, which is the starting point of the present invention, the textiles are soaked with dye by means of the above cited features from top to bottom.

However such known methods incur the drawback that while indeed the textiles placed in the dyeing chamber are dyed by the dye liquor passing through the textiles from top to bottom, such dyeing is uneven because dye liquor intensity diminishes from below to above on account of the consumption of the dye-pigment particles.

SUMMARY OF THE INVENTION

This being the state of the art, the object of the invention is to create a method and equipment which, contrary to the known systems, makes it possible to deposit areas of dyes, which are markedly differing from one another, onto different textiles. Nevertheless uniform dye impregnation of the textiles is achieved with such picture-deposits.

The drawbacks of the prior art are solved by the present invention in that the dye liquor is made to pass from bottom to top through the textiles using highly pressurized transport media.

The media implementing the passage of the dye liquor through the textiles may be steam or air which also is forced through the textiles from below to above. In especially appropriate manner, the textiles are arranged in tightly packed layers, substantially superposed on each other without gaps in the dyeing chamber and are exposed therein to the pressurized media.

Such dyeing is highly economical because some 300 pieces in the form of jeans' jackets or slacks can be packed into a dyeing chamber of about 200 ltr capacity.

In this method, the higher media pressure applied to the textiles easily moves the dye liquor transported by steam or air through these textiles, thus providing uniform dyeing. On the other hand, uniform transfer of color pictures or the like also is feasible if so desired.

The differential loading may take place in steps, the textiles to be dyed being loaded sequentially (ie, in stages) in a dyeing chamber by the dye of several dye compartments.

This is especially feasible because the dye proportion in the textiles is so low that those dyes from the previous stage still present in the textiles shall only trivially affect the dye liquor forming in the dye compartments in the textile treatment in the next stage.

When loading a particular dyeing chamber, the intensity of the dye deposited on the textile may be changed by several circulations taking place between the dyeing chamber and the dye compartment, such circulation being about a minute for the above discussed order of magnitude. If only one dye compartment is being used, the same dye shall be deposited with each circulation, that is, the dyeing intensity will rise. If different dye compartments are used for the same dyeing chamber, the dye shall change if there are different dyes in the dye compartments. However, care must be taken in this respect that dyeing by several circulations may lead to ever darker colors or color pictures. The initial state of the textiles, which may be present in strongly crimped or wrinkled form and tightly packed in the dyeing chamber, is such that first the external parts of the textiles will be dyed, and this dyeing increases from the outside to the inside during the circulations with the same dye.

Accordingly, when lighter color sites must be produced, the dye must be supplied from a separate dye compartment in a further dyeing stage. This row of several dye compartments contains the particular dyes of the same color class, for instance for the color "blue" from light to dark blue, whereby the color intensity increasing from the brightest dye to the darkest dye.

If, in the row of compartments, dyeing containers with different dyes such as red, green, blue or the like are being used, then in the end the textile shall be dyed in such a way that it corresponds to these colors being subtractively mixed.

As a result, additional color overlaps and correspondingly altered colored pictures will be obtained.

The method of the invention further makes possible to modify within wide limits these color pictures. On one hand, coloring the picture may depend on the manner in which the goods are packed inside the dyeing chamber, whether they are fed to the container being wrinkled by compression or being laid flat and folded, or rolled or being in some other way tightly packed. In all these cases the color pictures and color patterns will change.

Another way to control these color pictures is to change the supply of dye liquor, air and/or steam with respect to volume and intensity, ie, to change it relative to the supply pressure, so that different rates of penetration of the textile occurs, which will also lead to different color pictures.

In one embodiment of the instant invention, dye compartments can be juxtaposed in large numbers, because it is especially advantageous that the hose lines between the dye compartments and the dyeing chambers be reversible such that a single dyeing chamber can be loaded from several dye compartments or vice-versa, a single dye compartment can load several dyeing chambers.

In an especially advantageous manner, communicating conduits are present between the particular dye compartment and the associated dyeing chamber of the equipment of the invention, which in multiple circulations return the steam, the steam condensate and the unconsumed dye liquor from the dyeing chamber into the dye compartment. Thus, a replenishment dye in the form of dye pigments is metered to the mixture of condensed steam and unconsumed dye liquor that accumulates in the dyeing container.

Additionally, specific sections of the supply conduits for air, dye liquor and steam are provided with outlet apertures of varying sizes, whereby different patterns also may be achieved. Appropriate changes can be implemented by changing the flow speed in the communication lines which, in turn, is implemented by changing the pumping output.

The conduits mounted at the base of the dyeing chamber may be heated, preferably with steam, in order that the temperature of the dye liquor issuing at the top, as well as the transport media such as steam and/or air, can be varied within wide limits. This feature, too, results in extensive changes in patterns.

Lastly, the processing time may be varied within wide limits, the number of circulations being increased accordingly. This feature also strongly affects the patterns.

The patterns can be further controlled by substantial time-differentials in loading by the individual dye compartments.

In addition to passing the dye liquor through the textiles to be loaded from below to the top, it is possible to pass the dye liquor in the reverse direction from top to bottom through the textiles, in this case by resorting to a suction pump. In some cases, it may be sufficient to merely use gravity.

Appropriately, the dye compartments shall be some distance above the dyeing chamber, thereby a gap is created that allows access for easily packing the textiles in various ways into the dyeing chamber.

Furthermore, the dye compartments may be mounted next to or below the dyeing chambers while using suitable pumps.

However, the textiles contained in the dyeing chamber also may be loaded from above to below with dye liquor or replenished dye liquor by placing a closed-loop conduit on the solidly packed textiles; said closed-loop conduit being connectable in the described manner to a dye compartment. Therefore, circulation is implemented through the closed-loop conduit to the supply lines mounted below the textiles, whereby the dye compartment containing the replenishing mixture is mounted above the dyeing chamber.

Because the initial dye is constantly re-used and replenished, it need not be disposed of as waste, being used up practically in its entirely.

The remaining dye components of the dye liquor are so minute that it may be appropriate to evaporate the water from the dye liquor so that the residual dye remain as the dry substance for storage and/or further use.

Because the dye is deposited at fairly high temperatures, it also follows that the dye in the textiles is not significantly removed during washing.

Moreover, the residual shrinkage of the textile fibers is substantially reduced.

Accordingly, the method and equipment of the invention offer the substantial advantages of saving material, water and energy. In state-of-the-art dyeing techniques, loom-crude fabric is fed to a finishing operation to desize the fabric and to subject it to pre-pressurizing and pre-dyeing. Then the fabric is custom-treated in dye works.

As a rule, wastes accumulate both in finishing and in dyeing because the dye liquor cannot be used up entirely. Additional energy is required because the fabric must be raised to the respective temperatures both when being finished and when being dyed. This entails heating and cooling the material several times, but such procedures are absent from the method of the present invention. In fact, the instant invention achieves an energy consumption one half to one fourth that of the known procedures.

In the subsequent processing in the garment industry, and following sewing, the finished ware is washed to customer specifications in a laundry using solvents such as detergents, bleaches, abrasives and chemical additives, whereby up to 95% of the absorbed dye intensity is rinsed out and the washed-out component is subsequently disposed of as waste.

Again, the subsequent washing entails considerable demand for energy and waste disposal, expansive flushing being required to rinse out the inserted solvents and chemical accessories and also the attacked dyes and finishing substances. Nevertheless, there remain chemical residual materials in the fabric, which may trigger skin reactions.

Whereas, in the state of the art, the dye initially is introduced in excess, the excess subsequently must be washed out in order to achieve a faded effect. The present invention, on the other hand, dyes the ware only until reaching the desired faded effect. As a result, only so much dye is being consumed as required to achieve a desired faded effect. The flushed out proportion, which may be as high as 95% of the dye, is eliminated. Because the dyes, finishing substances and chemical accessories are completely eliminated, they do not require expansive flushing or waste disposal.

Dye proportions that were not absorbed are recycled and replenished; hence, they need not be disposed of as wastes (no wastes in dyeing).

In the known procedures, the fabric or the finished garment floats in a large vat in the dye liquor. As a rule, the ware (the dyed good) also floats in the washing machine when being washed. In the method of the invention, however, the dyed good does not float, but instead it lies in the dyeing chamber in a tightly or loosely packed manner. Furthermore, the chamber may be of arbitrary size. The dye liquor is pumped stepwise from the dye compartment to the dyeing chamber toward and through the dyed good and can be controlled both as regards to its temperature and its flow through the dyed good.

The controlled system of compressed-air and oxygen present in the dyeing chamber additionally affects the dyeing liquor by bubbling, thereby generating changes in color at the dyed good. Moreover, a controlled steaming system is provided which, after the particular dyeing-stage liquor has been pumped off, will steam the dyed good and hence cause changes in colors and different absorptions. The steaming system furthermore can be used to enhance dyeing. Because of repeated steaming between the dyeing stages and/or during dyeing, dye fastness is high and residual shrinkage is minimized. Therefore, chemical dyeing and finishing accessories can be dispensed with entirely.

The entire dye liquor is always fed to the dye compartment again and following use is kept thermally and mechanical fresh in the technical sense until re-use.

As a result, the dyes can be mixed in arbitrary manner. The dye liquor then is pumped to-and-fro through one or more mixed-dye containers in the same way as for the dyeing chamber(s) and dye compartment. If the entire group of dyes or dye inputs should then no longer be needed, the residual dye liquor may be evaporated by an evaporator facility. The resulting condensate, which is pure distilled water, may be used for other purposes, in addition, the generated dry solid component (residual dye pigments) may be re-used later. The involved steam input is also fed to the overall plant in a closed circuit.

Finally, the dyed, squeezed and already shaped wet material is suspended in a drying and crease-removing apparatus from waist or shoulder hangers and is kept in motion during the entire drying time using a suitable drying device such as a wind tunnel. As a result, the goods can be removed in already crease-free and soft-flowing condition. This substantially reduces the otherwise required substantial ironing effort.

Because its demand for water is minimal, the equipment of the invention need not be hooked-up with a waste disposal system.

The invention is elucidated below by means of illustrative embodiments shown in the drawing.

DESCRIPTION OF THE PREFERRED EMBODIMENT

Figure 1:
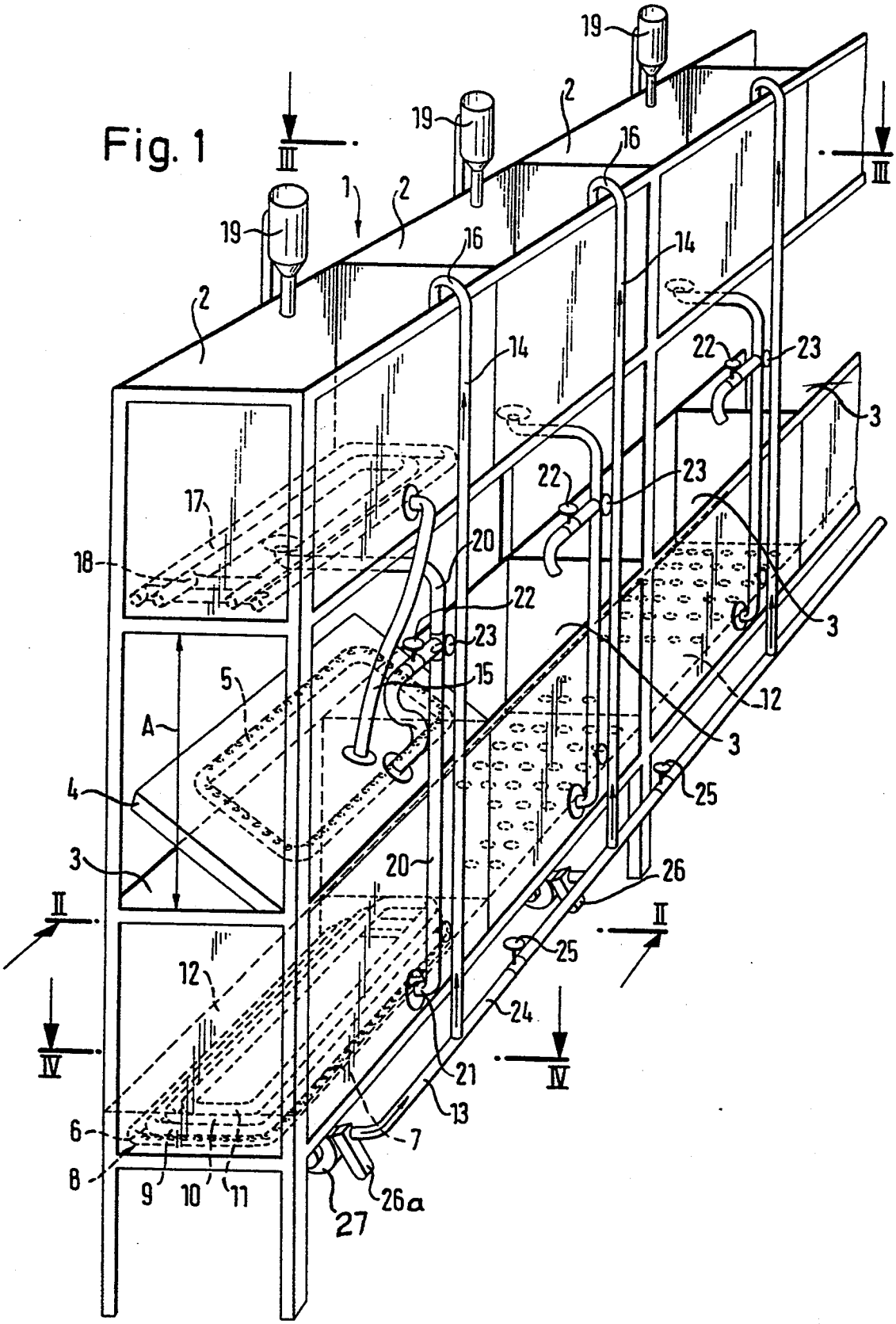
FIG. 1 is a perspective view of an embodiment of equipment of the invention with which to carry out the method of the invention.

The equipment shown in FIG. 1, which carries out the method of the invention, consists of a row 1 of dye compartments 2 juxtaposed one against the other and containing the dye liquor that shall be processed. The row 1 is mounted above dyeing chambers 3 as indicated in part in dashed lines, one dyeing chamber 3 being associated with one dye compartment 2.

Both the dye compartments 2 and the dyeing chambers 3 are dye containers, but hereafter, the notation of "dyeing chamber" on one hand and of "dye compartment" on the other will be retained and used solely to keep the description clear.

The dye compartments 2 are mounted a distance A above the dyeing chambers 3, and as a result the gap can be used to facilitate introducing and removing the textiles being processed in the dyeing chambers 3.

The dyeing chambers 3 are sealed by a lid 4 which may comprise a return conduit 5 to allow the dye liquor to act from above on the textiles in the chambers 3.

Accordingly, the dye is deposited by means of the return conduit 5 from above in the manner of a "dye showerhead".

The dye-soaking of the textiles in the chambers 3 is carried out from below the textiles by means of a conduit 6 comprising upwardly directed supply apertures 7 by allowing the dye liquor to enter the base zone 8 of the dyeing chambers 3. Together with the dye supply conduit 6 (also see FIG. 4), further closed-loop conduits 9, 10 and 11 (see FIG. 4, wherein the conduits are shown inside to outside) are mounted symmetrically with the closed-loop conduit 6, conduit 9 being used for steam heating, conduits 10 and 11 serving to supply saturated steam and air respectively.

A perforated base plate 12 is located directly above these conduits and covers all conduits relative to the textiles to be processed, therefore, these textiles cannot come into direct contact with the conduits.

As already discussed above, the air and saturated steam media are fed by means of a raised pump having output at higher pressure to the dyeing chambers 3. In this manner, the textiles are soaked-through.

In order to fully soak the textiles on one hand and on the other to ensure that the dye liquid shall be re-used, the dye-liquor supply conduits 6 are mounted in such a way that the dye liquid can circulate through the dye compartments 2. For that purpose, the dye-liquor supply conduit 6 is connected by a supply conduit 13, which forms a return/circulation conduit, to a vertical and pressurized overflow conduit 14, that, as shown in FIG. 1, passes through a bend 16 to issue into one of the dye compartments 2. In the shown embodiment, each dye compartment 2 is provided with such a supply conduit 14.

Moreover, a pressurized conduit 15 is provided between the lid 4 and the dye compartment 2, through which used dye liquor also can be fed to the dye compartment 2.

The dye compartment 2 at the top also is equipped in its base zone with closed-loop supply conduits 17 for steam heating and with a closed-loop conduit 18 for air supply, the former feeding the steam distillate, ie the water, to the dye compartment 2.

The dye liquor contained in the dye compartment 2 inherently is less intense in color than the initially employed dye liquor, and therefore, replenishing dye in the form of pigment is added by means of dye-metering apparatus 19 to the dye liquor in the dye compartments 2. Thus, follow-up mixing is carried out by the metering apparatus 19 so that the dye liquor contained in the dye compartment following the mixing will approximately match the initial dye-liquor intensity.

The dye liquor so treated is resupplied either by pumps or on account of gravity through a preferably vertical conduit 20 to the lower dyeing chamber 3, as shown. The feed in the base zone of the chamber 3 is denoted by 21.

The reference 22 denotes a shutoff valve and 23 an associated control valve. These components recur in every equipment stage. Moreover, shutoff valves 25 are present in the dye return and circulation conduit 24 connected to conduits 6 and 13, so that if called for the particular equipment sections may be isolated from each other. The reference 27 denotes pumps mounted in this conduit and **26*a*** denotes the associated filters, which however are outside the object of the present invention.

Figure 2:
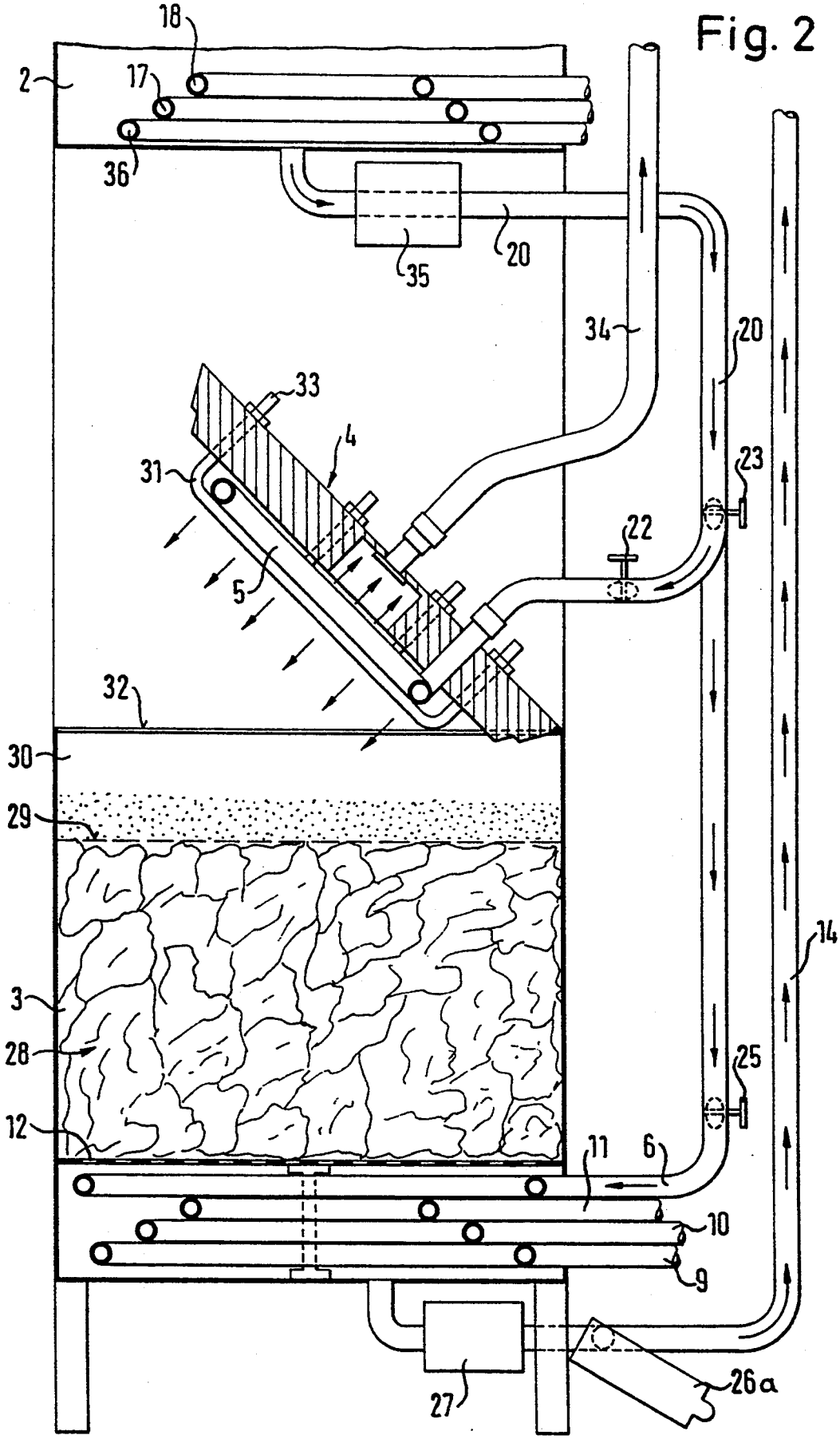
FIG. 2 is a section view taken along line II—II of FIG. 1.

FIG. 2 is a section approximately along line II—II of FIG. 1 and it elucidates the design in that zone. As follows from FIG. 2, the filter **26*a* (See FIG. 1) and a pump 27 are mounted in the substantially vertical dye-liquor circulation conduit 14 to move the dye liquor in the conduit 14 in the direction of the arrows. As further shown by FIG. 2, the individual closed-loop conduits for steam heating 9 and for air and saturated steam 10 and 11 also may be mounted in such a way that they are not coplanar but instead are staggered one above the other. In that case the particular upper closed-loop conduit forms the dye-liquor supply conduit 6. As schematically indicated in FIG. 2, the dye-good 28 may be held irregularly and wrinkled in the dye chamber 3 in order to make uneven patterns on the textiles. The liquid level in the dyeing chamber 3 is denoted by 29, a pressurized space 30 being formed above this level 29**.

FIG. 2 furthermore shows design details of the lid 4 (see FIG. 1) for the dyeing chamber, the lid 4 may be fitted with a squeezing stamp 31 to rid textiles being removed from excess liquid. In that regard, the textiles are pressed against a plane surface 32, a frame or the like. As shown in FIG. 2, the lid 4 can be connected to the closed-loop conduit 5 (see FIG. 1) forming the dye showerhead.

Moreover, the lid 4 may be fitted with a compressed-air hookup 33 which, when the lid 4 is closed, forms the excess pressure in the chamber 3.

Furthermore, the dye-liquor supply conduit 20 (see FIG. 1) may be hooked-up to the lid 4, also a pressurization conduit 34, simultaneously serving to return the condensate, may be connected to the lid 4.

The dye-liquor supply conduit 20 issues in the base of the upper dye compartment 2 and runs downward and may be provided with a forcing and acceleration pump 35 that is turned ON and OFF as called for. As already described in relation to FIG. 1, closed-loop conduits 17 and 18 for the air supply and steam heating and 36 for generating the excess pressure may be present in the base zone of the dye compartment 2.

The excess pressure generated in the dye compartments 2 or in the chambers 3 therefore serves not only to better soak the ware 28 to be processed, but also makes it possible to achieve in relatively simple manner constant circulation between the containers 2 and 3 for better utilization of the dye liquor.

Figure 3:
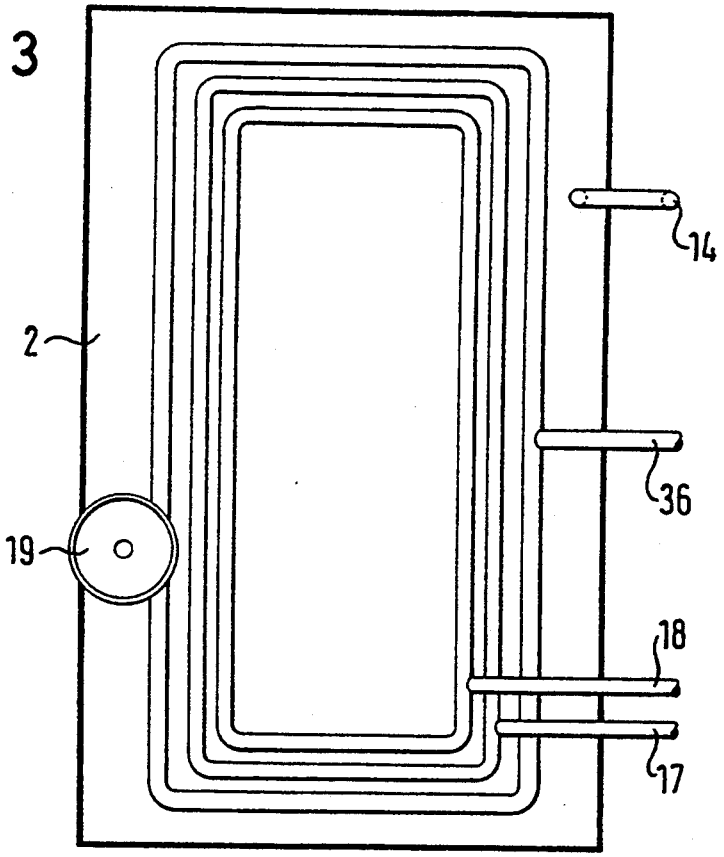
FIG. 3 is a top view taken along the line III—III of FIG. 1.

FIG. 3 is a top view of the conduits in the base zone of one of the dye compartments 2, to wit the closed-loop conduit 36 for the excess pressure and the condensate return, the closed-loop conduit 17 for steam heating and the closed-loop conduit 18 for air supply. It further shows the dye supply conduit of the already consumed dye liquor from the dyeing chamber 3, and said conduit is denoted here as in the other Figures by the reference 14.

Figure 4:
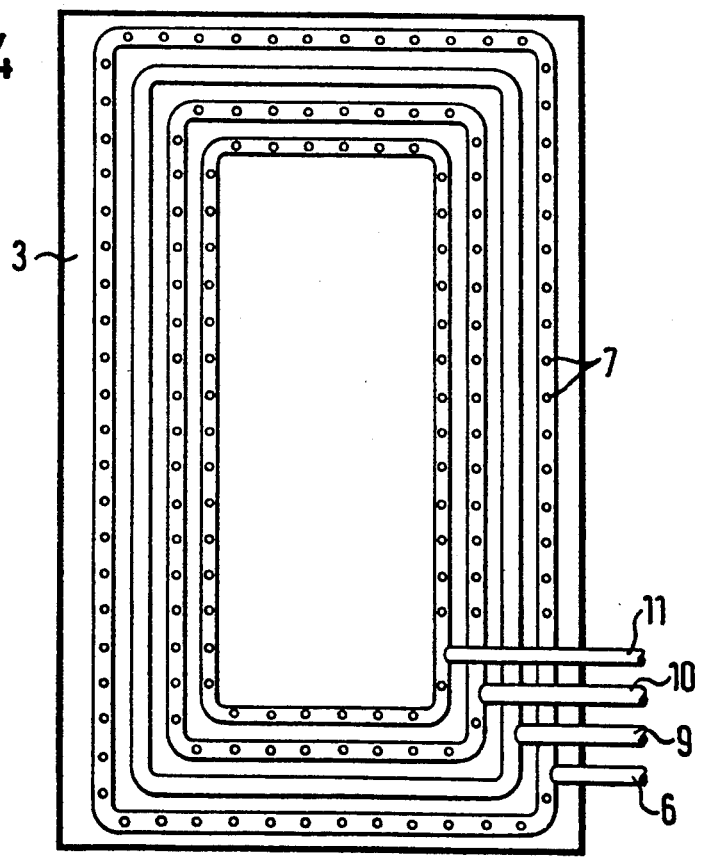
FIG. 4 is a top view and a partial section taken along line IV—IV of FIG. 1.

FIG. 4 is the view approximately along line IV—IV of FIG. 1 and shows the four closed-loop conduits 6, 9, 10 and 11 which are essentially concentric to one another and are mounted in the base zone of the chamber 3.

The textiles 28 are arranged in tightly packed layers, substantially superposed on each other without gaps in the dyeing chamber 3 and are exposed therein to the pressurized media.

Higher media pressure applied to the textiles 28 easily moves the dye liquor transported by steam or air through these textiles 28, thus providing uniform dyeing. On the other hand uniform transfer of color pictures or the like also is feasible.

Differential loading may take place in steps, the textiles 28 to be dyed being loaded sequentially (i.e. in stages) in a dyeing chamber 3 by the dye of several dye compartments 2. This is especially feasible because the dye proportion in the textiles 28 is so low that those dyes from the previous stage still present in the textiles 28 shall only trivially affect the dye liquor forming in the dye compartments 2 in the textile 28 treatment in the next stage.

When loading a particular dyeing chamber 3, the intensity of the dye deposited on the textile 28 may be changed by several circulations taking place between the dyeing chamber 3 and the dye compartment 2. If only one dye compartment 2 is being used, the same dye shall be deposited with each circulation, that is, the dyeing intensity will rise. If different dye compartments 2 are used for the same dyeing chamber 3, the dye shall change if there are different dyes in the dye compartments 2.

When lighter color sites must be produced, the dye must be supplied from a separate dye compartment 2 in a further dyeing stage. This row 1 of several dye compartments 2 contains the particular dyes of the same color class, for instance for the color "blue" from light to dark blue, whereby the color intensity increasing from the brightest dye to the darkest dye. If, in the row 1 of compartments 2, dyeing containers with different dyes such as red, green, blue or the like are being used, then in the end the textile 28 shall be dyed in such a way that it corresponds to these colors being subtractively mixed.

Coloring the picture may depend on the manner in which the goods are packed inside the dyeing chamber 3, whether they are fed to the container being wrinkled by compression or being laid flat or folded, or rolled or being in some other way tightly packed. Another way to control these color pictures is to change the supply of dye liquor, air and/or steam with respect to volume and intensity, i.e. to change the supply relative to the supply pressure, so that different rates of penetration of the textile 28 occurs.

The hose lines 15, 20 between the dye compartments 2 and the dyeing chambers 3 can be reversible such that a single dyeing chamber 3 can be loaded from several dye compartments 2 or vice-versa, a single dye compartment 2 can load several dyeing chambers 3.

The supply conduits for air 11, dye liquor 6 and steam 10 are provided with outlet apertures 7 of varying sizes, whereby different patterns also may be achieved.

The conduits mounted at the base of the dyeing chamber 3 may be heated, preferably with steam, in order that the temperature of the dye liquor issuing at the top, as well as the transport media such as steam and/or air, can be varied within wide limits.

The processing time may be varied within wide limits, the number of circulations being increased accordingly.

It is possible to pass the dye liquor in the reverse direction from top to bottom through the textiles 28, in this case resorting to a suction pump 27. In some cases, it may be sufficient to merely use gravity.

While the invention has been particularly shown and described with reference to a preferred embodiment, it will be understood by those having ordinary skill in the art that various changes in form and detail may be made therein without departing from the spirit and scope of the invention.

I claim:

1. A method for dyeing textiles in a dyeing chamber, said dyeing chamber including a base zone with upwardly directed supply apertures and several mutually separate dye compartments mounted above said dyeing chamber, said method comprising the steps of:

receiving a plurality of textiles to be simultaneously treated in the dyeing chamber, said plurality of textiles are received between said base zone and said dye compartments;

diluting a dye liquor in each of said dye compartments;

pressurizing each said diluted dye liquor with a transport media; and loading the textiles with at least one of the diluted dye liquors by passing the at least one diluted dye liquor through the textiles from said upwardly directed supply apertures, through said textiles, toward said dye compartments.

2. The method defined in claim 1, characterized in that the media is steam.

3. The method defined in claim 1, characterized in that the at least one dye liquor is forced through the textiles from below the textiles toward the top of the textiles.

4. The method defined in claim 1, characterized in that the textiles are subjected to loading with said dye via the pressurized media while being tightly packed in layers and being essentially superposed without gaps in the dyeing chamber.

5. The method defined in claim 1, characterized in that the loading of the textiles with the at least one dye liquor is carried out in partial sequential steps.

6. The method defined in claim 5, characterized in that the textiles to be dyed are loaded sequentially in a single dyeing chamber with dye from several dye compartments.

7. The method defined in claims 6, characterized in that the intensity of the deposited color is changed by several circulations of said dye taking place between the dyeing chamber and the dye compartment.

8. The method defined in claim 7, characterized in that a single circulation lasts about a minute.

9. The method defined in claims 8, characterized in that different dye compartments are used for the same dyeing chamber.

10. The method defined in claim 7, characterized in that a single dye compartment is used, the same dye being deposited for each circulation.

11. The method defined in claim 1, characterized in that the textiles to be dyed are tightly packed on top of each other and in wrinkled or strongly crimped form in the dyeing chamber.

12. The method defined in claim 1, characterized in that a relatively darker color site is supplemented and/or replaced by a relatively lighter one, the coloring being implemented by a single dye compartment with a single dyeing chamber.

13. The method defined in claim 12, characterized in that the lighter color sites are prepared by supplying an inherently lighter dye in a subsequent stage.

14. The method defined in claim 1, characterized in that the further dyeing stage is implemented with a dye provided in a separate dye compartment.

15. The method defined in claim 1, characterized in that the manner of packing the textiles inside the dyeing chamber, namely wrinkling, smooth layout, bunching, rolling etc., affects a color-patterning of the textiles.

16. The method defined in claim 1, characterized in that the color patterning is affected by the supply of the dye liquor, of air and/or steam, the coloring being changed by changing a supply rate of these media.

17. The method defined in claim 1, characterized in that the media is air.

* * * * *